US005983391A

United States Patent [19]

Palmer et al.

[11] Patent Number: 5,983,391

[45] Date of Patent: Nov. 16, 1999

[54] MARTIAL ARTS PROTECTIVE DEVICE

[76] Inventors: Jeffrey C. Palmer; John Baxter, both of 1000 Oakfield La., Wilmington, Del. 19810

[21] Appl. No.: 09/108,515

[22] Filed: Jul. 1, 1998

[51] Int. Cl.[6] ..... A41D 13/08; A41D 13/00

[52] U.S. Cl. ..... 2/16; 2/22; 2/455

[58] Field of Search ..... 2/16, 17, 2.5, 22, 2/161.1, 161.6, 167, 414, 455, 456, 267, 24

[56] References Cited

U.S. PATENT DOCUMENTS

| | | | |
|---|---|---|---|
| 3,866,909 | 2/1975 | DeSantis | 272/76 |
| 4,011,596 | 3/1977 | Chang | 2/16 |
| 4,213,202 | 7/1980 | Larry | 2/2 |
| 4,872,215 | 10/1989 | Sliger | 2/2 |
| 5,090,053 | 2/1992 | Hayes | 2/2 |
| 5,173,967 | 12/1992 | Carter | 2/16 |
| 5,488,739 | 2/1996 | Cardinal | 2/161.1 |
| 5,511,242 | 4/1996 | Bianchi | 2/16 |
| 5,542,121 | 8/1996 | Lahaussois et al. | 2/16 |
| 5,570,470 | 11/1996 | Miller | 2/22 |
| 5,655,221 | 8/1997 | Worischeck | 2/16 |
| 5,674,189 | 10/1997 | McDowell et al. | 2/16 |

*Primary Examiner*—John J. Calvert
*Assistant Examiner*—Gary L. Welch
*Attorney, Agent, or Firm*—Henderson & Sturm

[57] ABSTRACT

A protective device 10 for a user's arms and legs including a compartmented cover member 20 dimensioned to encircle a portion of a selected one of the user's arms and legs and provided with a plurality of generally identical shock absorbing units 12 dimensioned to be received in a plurality of generally identical compartments 26 disposed on the cover member 20 in a closely aligned side by side fashion.

1 Claim, 4 Drawing Sheets

MARTIAL ARTS PROTECTIVE DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of protective devices in general, and in particular to a protective device that is specifically designed for the practitioners of martial arts.

2. Description of Related Art

As can be seen by reference to the following U.S. Pat. Nos. 3,866,909; 4,213,202;, 4,872,215; and 5,090,053, the prior art is replete with myriad and diverse protective gear constructions.

While all of the aforementioned prior art constructions are more than adequate for the basic purpose and function for which they have been specifically designed, they are uniformly deficient with respect to their failure to provide a simple, efficient, and practical protective device specifically designed to provide protection for the user's forearms and thighs.

As can be seen by reference to the above cited patents, the prior art devices seem to concentrate on providing protection for the user's tipper torso, while basically ignoring the user's arms and legs in general, and in particular the forearms and thighs which are the recipient of a large percentage of forcible blows delivered during martial arts training.

As a consequence of the foregoing situation, there has existed a longstanding need among practitioners of the martial arts for a new and improved protective device that provides impact resistant protection to the user's arms and legs while not infringing to any noticeable degree the mobility of the user in either the defensive or offensive mode, and the provision of such a construction is a stated objective of the present invention.

BRIEF SUMMARY OF THE INVENTION

Briefly stated, the martial arts protective device that forms the basis of the present invention comprises a compartmented outer cover unit and a plurality of shock absorbing units dimensioned to be received in the compartmented cover unit. In addition, this invention comes in a forearm encircling version and a thigh encircling version wherein the only difference between the two versions involves relative dimensions.

As will be explained in greater detail further on in the specification, both versions of the invention comprise a slightly tapered outer cover member provided with a plurality of slightly tapered compartments. Each compartment is disposed in a close side by side relationship with the other compartments and dimensioned to receive one of the plurality of shock absorbing units.

In addition, each of the generally identical shock absorbing units comprises an elongated slightly tapered shock absorbing member including a generally rigid force distributing plate having resilient layers provided on its front and rear faces. The shock absorbing members are closely aligned relative to one another in the plurality of compartments in a side by side relationship.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
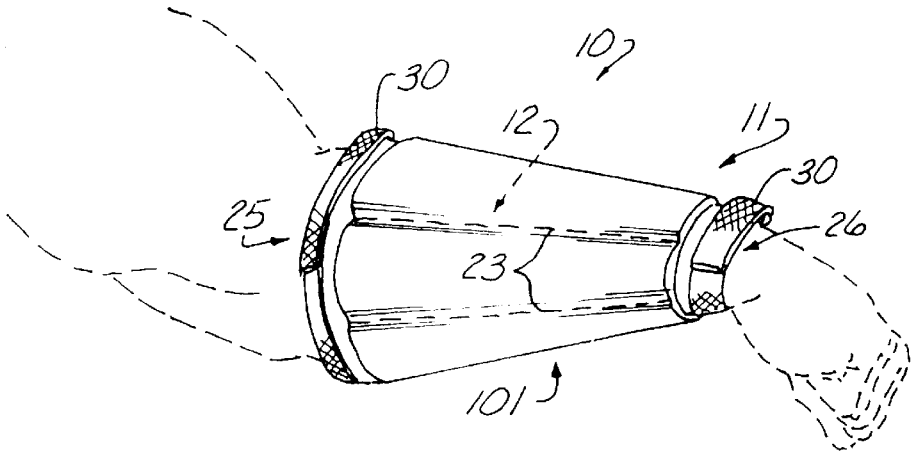
FIG. 1 is an isolated perspective view of the forearm version of the protective device.
Figure 2:
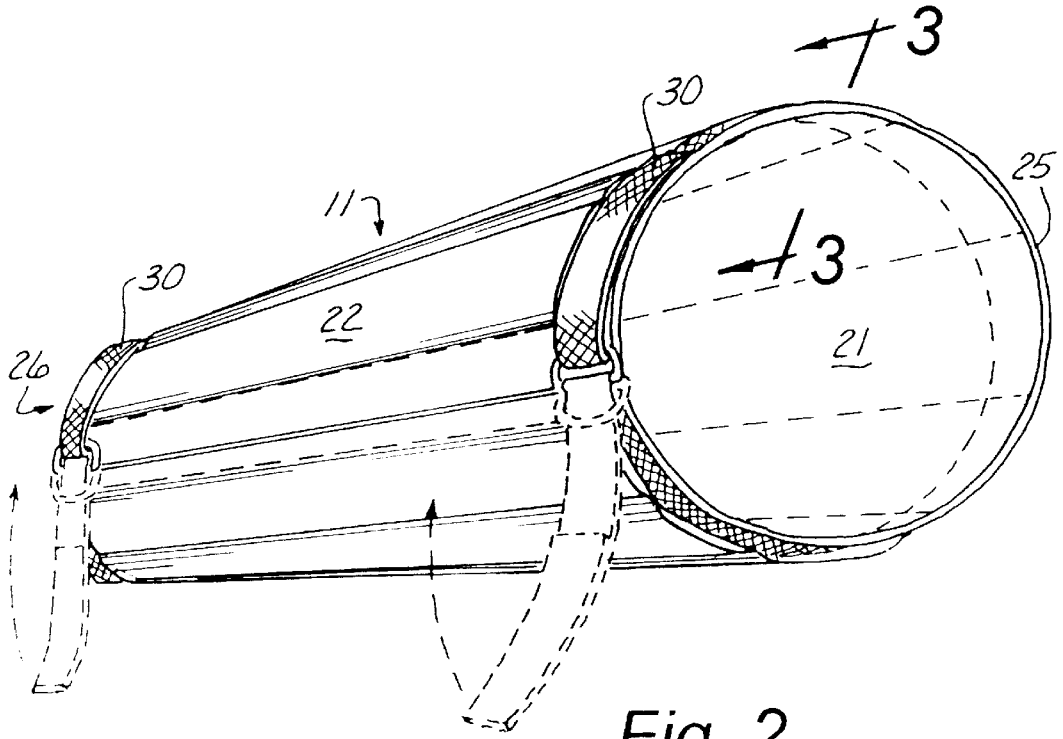
FIG. 2 is a perspective view of the forearm protective device as seen from the enlarged end and employing one type of securing mechanism.
Figure 3:
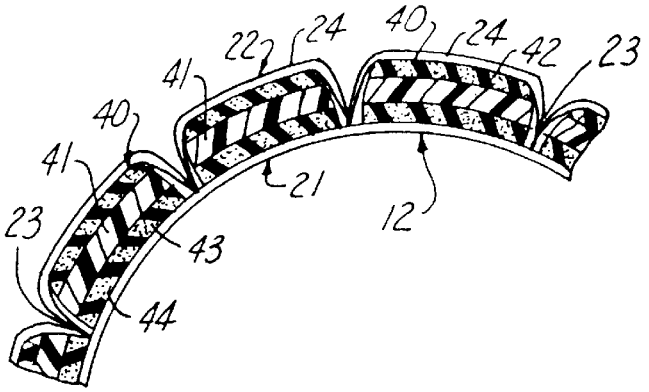
FIG. 3 is a cross sectional view taken through line 3—3 of FIG. 2.
Figure 4:
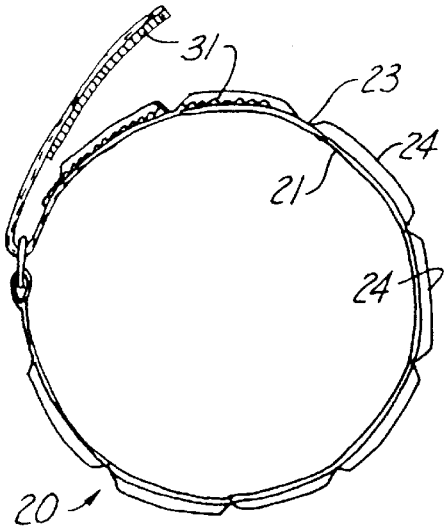
FIG. 4 is an end view of the forearm protective device.
Figure 5:
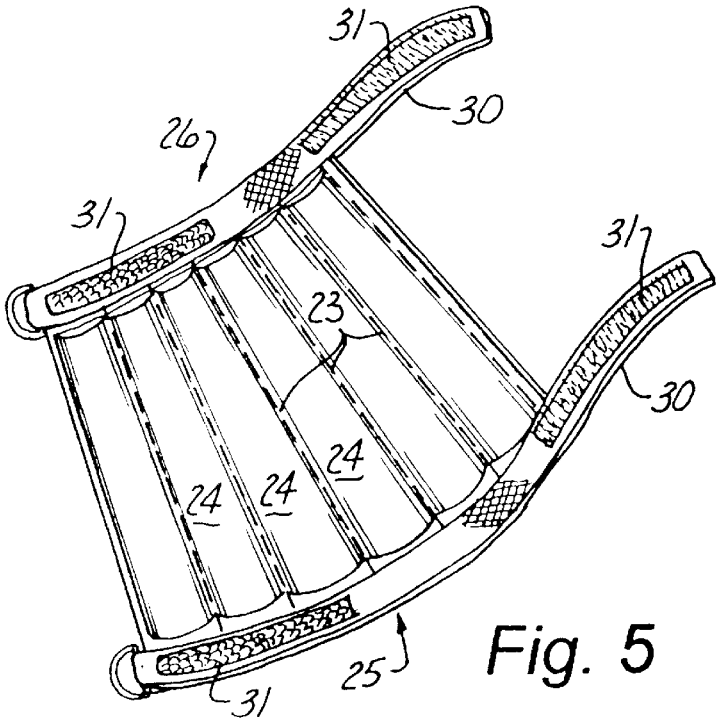
FIG. 5 is a top perspective view of the forearm protector device in the open position.
Figure 6:
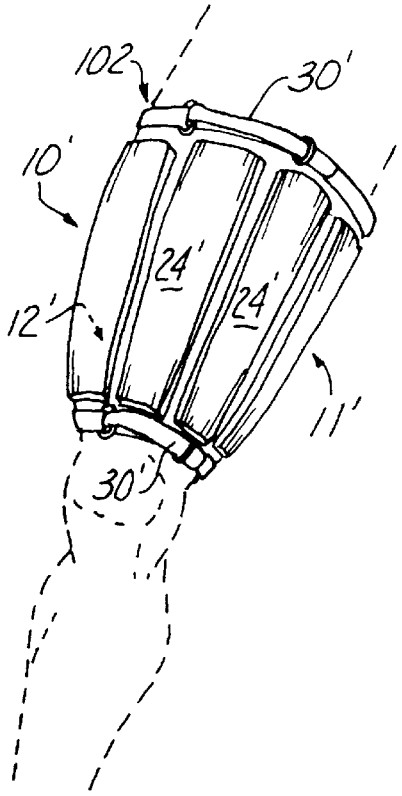
FIG. 6 is an isolated perspective view of the thigh version of the protective device.
Figure 7:
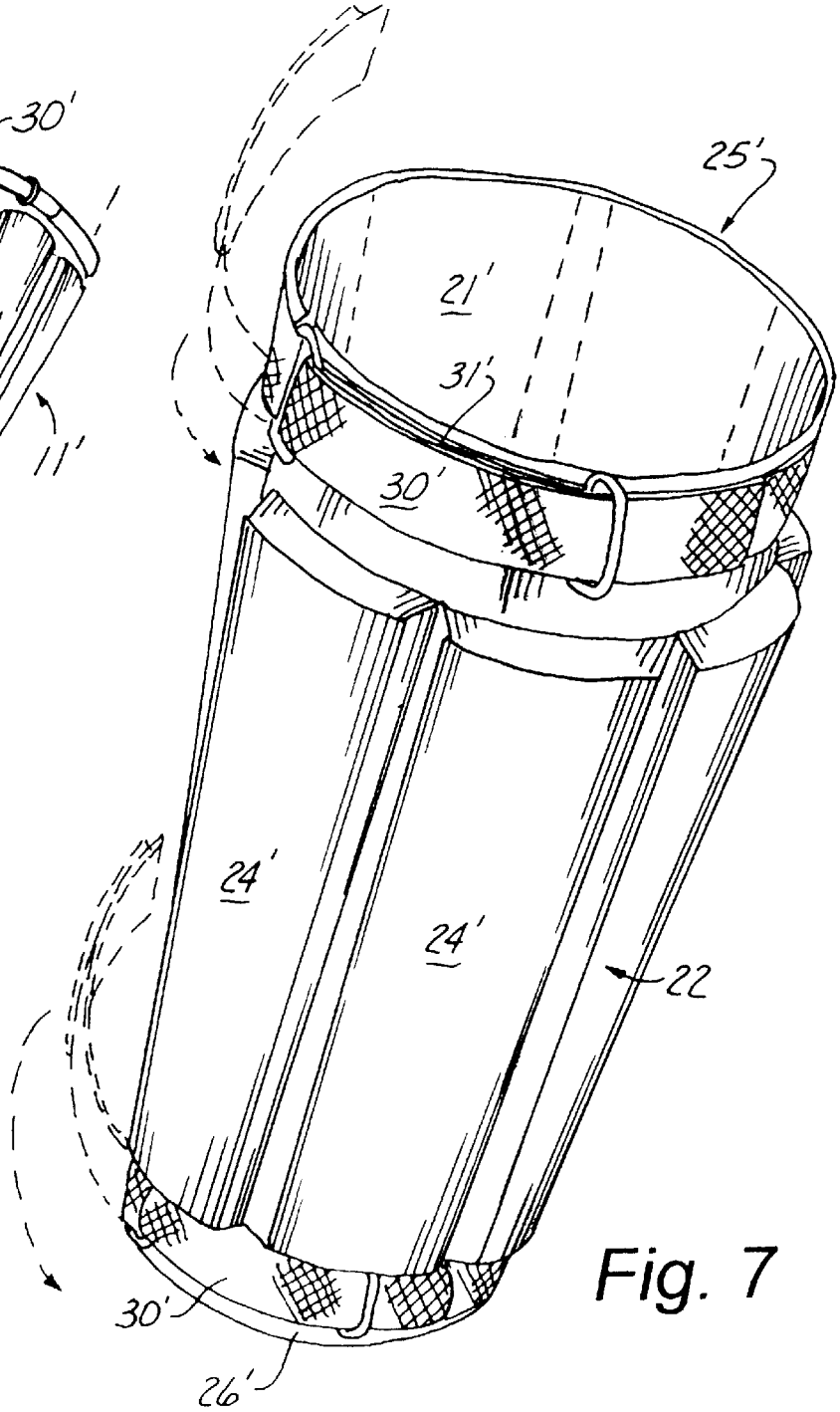
FIG. 7 is a front perspective view of the thigh protective device.
Figure 8:
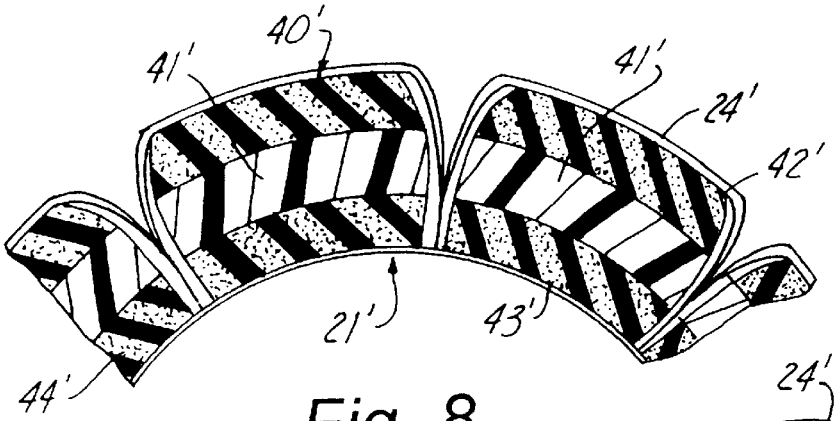
FIG. 8 is a cross sectional view of the thigh protective device.
Figure 9:
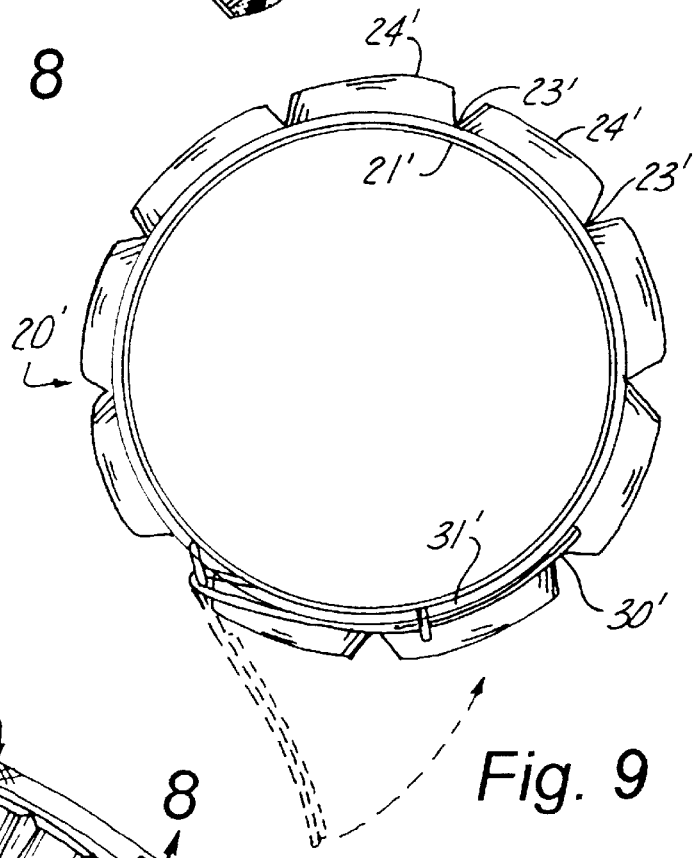
FIG. 9 is an end view of the thigh protective device.
Figure 10:
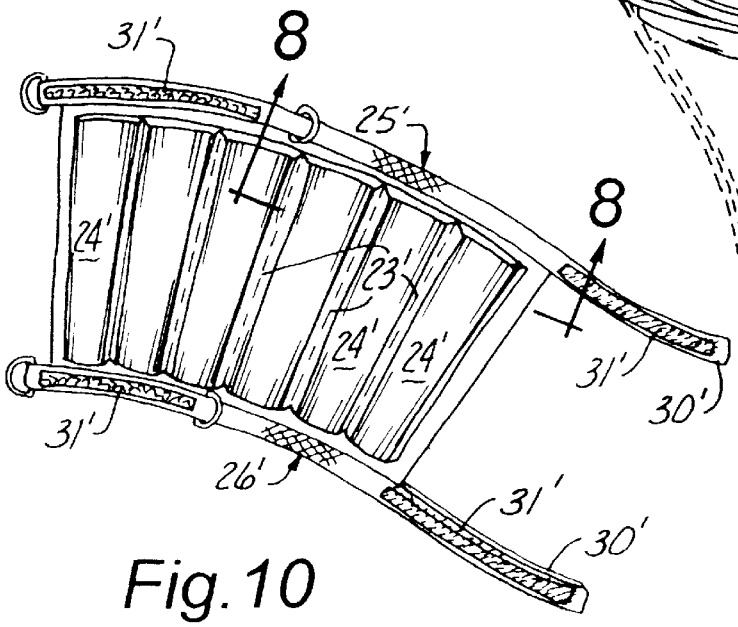
FIG. 10 is a top perspective view of the thigh protective device in the open position.

As can be seen by reference to the drawings, and in particularly to FIG. 1, the martial arts protective device that forms the basis of the present invention is designated generally by the reference number 10. The protective device 10 comprises in general, a compartmented outer cover unit 11 and a plurality of shock absorbing units 12 enveloped by the compartmented cover unit 11. These units will now be described in seriatim fashion.

As was mentioned previously in the specification, the protective device 10 comes in both a forearm version which will be designated by standard reference numerals and a thigh version which will be designated by prime reference numerals for the simple fact that the basic construction of both versions 10 and 10' are almost identical with the exception of the dimensions of the cover units 11, 11 ' and the thickness of the plurality of shock absorbing units 12, 12'.

In both versions of the invention, the cover unit 11, 11' comprises a cover member 20, 20' comprising an enlarged slightly tapered inner fabric panel 21, 21' and an outer fabric panel 22, 22' which is attached at generally equally spaced intervals as at 23, 23' to create a plurality of closely spaced slightly tapered elongated compartments 24, 24' that are closely aligned in a generally parallel, yet converging relationship relative to one another.

In addition, both the upper 25, 25' and lower 26, 26' portions of the inner fabric panels 21, 21' are provided with strap members 30, 30' provided with conventional fasteners designated generally as 31, 31' such as hook and loop fasteners provided with buckles for securing the cover members 20, 20', respectively to the user's forearms 101 or thighs 102 in a well recognized manner.

In the forearm version of the invention 10 illustrated in FIGS. 1 through 5, it can be seen that each of the generally identically shaped shock absorbing units 12 comprise an elongated slightly tapered shock absorbing member 40 dimensioned to be received in one of the compartments 24 formed on the front of the cover member 20.

Furthermore, each shock absorbing member 40 includes a generally rigid force distributing plate 41 manufactured from steel, hard plastic, KEVLAR or the like, which is covered on the front and rear faces by layers 42, 43 of resiliently deformable material 44 such as foam rubber or the like.

In the thigh version of the invention 10' illustrated in FIGS. 6 through 10, it can be seen that each of the generally identically shaped shock absorbing units 12' likewise comprise an elongated slightly tapered shock absorbing member 40' dimensioned to be received in one of the compartments 26' formed on the front of the cover member 20'.

Furthermore, each shock absorbing member 40' includes a generally rigid force distributing plate 41' manufactured form steel, hard plastic, KEVLAR or the like which is covered on the front and rear faces by layers 42', 43' of resiliently deformable material 44' such as foam rubber or the like.

It should also be appreciated at this juncture that both the forearm version 10 and the thigh version 10' completely encircle those respective portions of the user's anatomy. Furthermore, each of the compartments 26, 26' and the shock absorbing members 40, 40' are disposed in close proximity to one another such that the opposed sides of the adjacent compartments 26, 26' and the shock absorbing members 40, 40' are aligned parallel to one another.

This arrangement insures that the user's forearms and thighs are completely surrounded and protected by the protective device 10 while still permitting virtually unencumbered movement of those portions of the user's anatomy.

As can further be appreciated by reference to FIGS. 3, 5, 8, and 10, the only distinction between the forearm version 10 and the thigh version 10' are the relative dimensions of the two versions 10, 10'. The length mean circumference and thickness of the thigh version 10' is greater than the length mean circumference and thickness of the forearm version 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A protective device for a user's arms and legs wherein the protective device consists of:

a compartmented outer cover unit including a cover member having a slightly tapered inner fabric panel dimensioned to encircle a portion of a selected one of the user's arms and legs and a slightly tapered outer fabric panel attached at generally equally spaced intervals to the inner fabric panel to create a plurality of closely spaced, elongated, tapered compartments; disposed in a side-by-side relationship to one another entirely across the exterior periphery of the cover member wherein the cover member has an upper portion disposed above said plurality of closely spaced compartments and a lower portion disposed below said plurality of closely spaced compartments;

a plurality of slightly tapered shock absorbing units dimensioned to be received in said plurality of closely spaced compartments wherein each of the shock absorbing units includes a generally rigid force distributing plate having a front face and a rear face wherein both the front and rear faces are provided with a layer of resilient material; and a plurality of strap members disposed on the upper and lower portion of the cover member and provided with conventional fasteners for releasably securing the cover member to a selected one of the user's arms and legs; wherein, the adjacent opposed sides of the shock-absorbing units and the plurality of compartments are aligned parallel to one another.

* * * * *